US010968003B2

(12) United States Patent
Buckby

(10) Patent No.: US 10,968,003 B2
(45) Date of Patent: Apr. 6, 2021

(54) LABELLING MACHINE DESIGN FOR GS1 COMPLIANCE

(71) Applicant: VIDEOJET TECHNOLOGIES INC., Wood Dale, IL (US)

(72) Inventor: Steven Buckby, Nottinghamshire (GB)

(73) Assignee: VIDEOJET TECHNOLOGIES INC., Wood Dale, IL (US)

( * ) Notice: Subject to any disclaimer, the term of this patent is extended or adjusted under 35 U.S.C. 154(b) by 1018 days.

(21) Appl. No.: 14/901,863

(22) PCT Filed: Oct. 10, 2014

(86) PCT No.: PCT/GB2014/053049

§ 371 (c)(1),
(2) Date: Dec. 29, 2015

(87) PCT Pub. No.: WO2015/052530

PCT Pub. Date: Apr. 16, 2015

(65) Prior Publication Data

US 2019/0193888 A1 Jun. 27, 2019

(30) Foreign Application Priority Data

Oct. 11, 2013 (GB) ..... 1318046

(51) Int. Cl.
*B65C 9/18* (2006.01)
*B65C 1/02* (2006.01)
(Continued)

(52) U.S. Cl.
CPC ..... *B65C 9/1892* (2013.01); *B65C 1/02* (2013.01); *B65C 9/00* (2013.01); *B65C 9/0006* (2013.01);
(Continued)

(58) Field of Classification Search
CPC ... B65C 9/1865; B65C 9/1869; B65C 9/1892; B65C 2009/0009
See application file for complete search history.

(56) References Cited

U.S. PATENT DOCUMENTS 7,150,572 B2 * 12/2006 McNestry ..... B41J 2/325 400/223
2003/0034111 A1 * 2/2003 Oldenburg ..... B65C 3/08 156/64

(Continued)

FOREIGN PATENT DOCUMENTS

| | | |
|---|---|---|
| WO | 20060105788 | 10/2006 |
| WO | 20100018368 | 2/2010 |
| WO | 20120097906 | 7/2012 |

*Primary Examiner* — Philip C Tucker
*Assistant Examiner* — John Blades
(74) *Attorney, Agent, or Firm* — Wolter Van Dyke Davis, PLLC; Robert L. Wolter

(57) ABSTRACT

A labelling machine comprises a supply spool support for supporting a spool of label carrying web, a labelling station arranged to remove labels from a label carrying web supported by the supply spool, a take up spool support for supporting web from which labels have been removed, and a first motive apparatus for transporting web from the supply spool support to the take up spool support via the labelling station. The supply spool support, the labelling station and the take up spool support are mounted to a base plate. The base plate includes a first portion which supports the labelling station via a base of the labelling station such that the labelling station extends from the base plate in a first direction, and a second portion. The maximum distance to which the second portion and any component supported by the second portion extend from the base of the labelling station in a second direction is greater than the maximum distance to which the first portion and any component supported by the first portion extend from the base of the
(Continued)

labelling station in the second direction, the first and second directions being generally opposite.

16 Claims, 3 Drawing Sheets

(51) Int. Cl.
*B65C 9/46* (2006.01)
*B65C 9/00* (2006.01)

(52) U.S. Cl.
CPC ..... *B65C 9/1865* (2013.01); *B65C 9/1869* (2013.01); *B65C 9/46* (2013.01); *B65C 2210/0054* (2013.01)

(56) References Cited

U.S. PATENT DOCUMENTS

2006/0265947 A1* 11/2006 Siedlaczek ..... A01G 9/081 47/1.01 P
2013/0175289 A1* 7/2013 Sternberg ..... B65C 9/1869 221/70

* cited by examiner

LABELLING MACHINE DESIGN FOR GS1 COMPLIANCE

The present invention relates to a labelling machine and particularly to a labelling machine for use with label stock comprising a web and a plurality of labels attached to the web and which are separable from the web. Such machines are sometimes referred to as "roll-fed self-adhesive labelling machines".

Label stock comprising a web carrying labels is usually manufactured and supplied as a wound roll (hereinafter referred to as a spool). For a given spool, all the labels are typically the same size, within manufacturing tolerances. However, in some instances, this is not the case.

Labels are commonly used to display information relating to an article and are commonly disposed on the article such that the information is easily readable either manually or automatically. Such labels may, for example, display product information, barcodes, stock information or the like. Labels may be adhered to a product or to a container in which the product is packaged.

In the manufacturing industry, where such labels are read automatically, it is important for the information to be printed such that it is clear and positioned accurately so that an automated reader can consistently and correctly read the information.

Some known labelling machines apply pre-printed labels to an article. Other known labelling machines print information onto labels immediately before printed labels are applied to an article. Such labelling machines may be referred to as print and apply labelling machines.

It is desirable to be able to advance a web of labels to be applied to an article accurately, so as to ensure that print is accurately positioned on the label and/or to ensure that the label is accurately positioned on the article. This may be particularly important in print and apply labelling machines in which printing is typically carried out while the label moves relative to the printhead, making accurate control of the label (and hence the label stock) important if printing is to be properly carried out such that the desired information is correctly reproduced on the label.

Given that labels are often removed from the moving web by passing the label stock under tension around a labelling peel beak (sometimes referred to as a peel beak, a peel blade or a label separating beak), it is sometimes desirable to ensure that a predetermined optimum tension in the web of the label stock is maintained. In some applications, it is also desirable that the label stock can be moved at a predetermined speed of travel along a defined web path, so as to ensure that the speed at which labels are dispensed is compatible with the speed at which products or containers move along a path adjacent the device.

It is therefore desirable in the manufacturing industry for there to be means and a method for transporting a label stock and applying labels from the web of the label stock to a product or container, which is accurate, reliable, simple to use and adaptable to different applications.

As previously discussed a known type of labelling machine which incorporates a printer may be referred to as print and apply labelling machine. A known type of print and apply labelling machine is a 'last label out' labelling machine. 'Last label out' labelling machines function so as to print a specific label for a specific article and then apply that label to the specific article. For example, a 'last label out' labelling machine may operate such that for each article that passes the labelling machine a unique label is printed and then applied to the article. In some 'last label out' machines the printed label differs for each article, whereas in other 'last label out' machines the printed label may differ during the course of a production batch passing the labelling machine. Due to the fact that 'last label out' labelling machines may print a unique label for each article before it is applied to the article, it is common for the printer of the labelling machine to be located in close proximity to the labelling peel beak. The location of the printer adjacent the labelling peel beak may make the portion of the labelling machine which includes the labelling peel beak bulky.

Certain known label and/or barcode positioning standards require that labels incorporating a barcode are applied by the labelling machine at a particular position on an article. For example, if the labelling machine is configured to apply labels to articles which pass the labelling machine on a conveyor, then known label positioning standards may necessitate that the labelling machine is configured to apply labels to each article on the conveyor at less than a predetermined height from the conveyor and at a less than a predetermined distance from a front edge of the article.

In cases where known print and apply labelling machines of the 'last label out' type are required to apply labels to articles at a relatively low height from a conveyor, due to the fact that the portion of the labelling machine which includes the labelling peel beak is bulky, it may not be possible to position such a known print and apply labelling machine of the 'last label out' type adjacent the conveyor such that labels can be printed and subsequently applied to an article at a position adjacent the labelling peel beak and printer of the labelling machine.

In order to solve this problem, known print and apply labelling machines of the 'last label out' type may be located at a position such that the labelling peel beak and printer are remote from the conveyor (and hence articles on the conveyor). The labelling machine may also incorporate a tamp (or any other appropriate label transfer device) which is controllably moved so as to transfer each label from the labelling peel beak of the labelling machine and subsequently apply it to the required position on each article. However, the use of a tamp (or any other appropriate label transfer device) in this manner may be disadvantageous.

For example, the label transfer means will increase the complexity and cost of the labelling machine. In addition, the label transfer device is an additional component of the labelling machine which may fail, thus causing the labelling machine to become inoperable. Furthermore, the time it takes for a printed label to be transferred by the label transfer device from the labelling machine to the desired article on the conveyor may increase the time it take for labels to be applied to an article, thereby reducing the throughput of the labelling machine and/or conveyor.

Another problem with known print and apply labelling machines of a 'last label out' configuration is that it may not be possible to locate such a machine adjacent a conveyor of a production line such that the labelling machine can apply labels beneath a certain height on an article conveyed by the conveyor.

It is an object of embodiments of the present invention to obviate or mitigate one or more of the problems of known labelling machines whether set out above or otherwise, and/or to provide an alternative labelling machine.

A first aspect of the invention provides a labelling machine comprising: a supply spool support for supporting a spool of label carrying web, a labelling station arranged to remove labels from a label carrying web supported by the supply spool, a take up spool support for supporting web from which labels have been removed, and a first motive apparatus for transporting web from the supply spool support to the take up spool support via the labelling station. The supply spool support, the labelling station and the take up spool support are mounted to a base plate. The base plate includes: a first portion which supports the labelling station via a base of the labelling station such that the labelling station extends from the base plate in a first direction, and a second portion. The maximum distance to which the second portion and any component supported by the second portion extend from the base of the labelling station in a second direction is greater than the maximum distance to which the first portion and any component supported by the first portion extend from the base of the labelling station in the second direction, the first and second directions being generally opposite.

The present invention further provides a labelling machine comprising a supply spool support for supporting a spool of label carrying web, a labelling station arranged to remove labels from a label carrying web supported by the supply spool, a take up spool support for supporting web from which labels have been removed, and a first motive apparatus for transporting web from the supply spool support to the take up spool support via the labelling station, wherein the supply spool support, the labelling station and the take up spool support are mounted to a base plate, wherein the base plate includes a first portion which supports the labelling station via a base of the labelling station such that the labelling station extends from the base plate in a first direction, and a second portion, wherein the maximum distance to which the second portion and any component supported by the second portion extend from the base of the labelling station in a direction antiparallel to the first direction is greater than the maximum distance to which the first portion and any component supported by the first portion extend from the base of the labelling station in the direction antiparallel to the first direction.

A first wall may separate the first portion and the second portion, the first wall extending in a second direction which is generally opposed to the first direction.

According to another aspect of the present invention there is provided a labelling machine comprising a supply spool support for supporting a spool of label carrying web, a labelling station arranged to remove labels from a label carrying web supported by the supply spool, a take up spool support for supporting web from which labels have been removed, and a first motive apparatus for transporting web from the supply spool support to the take up spool support via the labelling station, wherein the supply spool support, the labelling station and the take up spool support are mounted to a base plate, wherein the base plate includes a first portion which supports the labelling station such that the labelling station extends from the base plate in a first direction, and a second portion, and wherein a first wall separates the first portion and the second portion, the first wall extending in a second direction which is generally opposed to the first direction.

The first and second directions may be generally antiparallel.

The first portion of the base plate may have a thickness which is less than that of the second portion of the baseplate. The thickness of the second portion of the baseplate may be defined by the extent of extension of the first wall in the second direction.

The first wall and the first portion of the base plate may define a space or recess therebetween configured to receive a portion of a production line.

The received portion of the production line may be such that the labelling machine can apply labels to articles on a conveyor such that the distance between an edge of the label and a surface of the conveyor is less than or equal to about 32 mm.

The first motive apparatus may comprise a first motor including a first stator and a first rotor; wherein the labelling station may extend from a surface on a first side of the base plate; and wherein the following components may be mounted to the base plate such that the majority of each component is located on the first side of the base plate: supply spool support, take-up spool support, and first stator.

The first wall may extend from a surface on a second side of the base plate, the second side may be generally opposed to the first side.

The labelling machine may be such that none of the supply spool support, take-up spool support, or first motive apparatus extend from the base plate in the second direction to an extent which is beyond that of the first wall.

The second portion of the base plate may support some or all of (or at least one of or all of) the supply spool support, take-up spool support and first motive apparatus.

The labelling machine may further include a printer for printing on labels of the label web.

The printer may include a printhead, the printhead being supported by the first portion of the base plate.

The printer may be a thermal printer, for example, a thermal transfer printer.

The printer may include: a ribbon supply spool support for supporting a ribbon supply spool comprising printer ribbon for the printer; a ribbon take-up spool support adapted to take up a portion of the printer ribbon; and a second motive apparatus configured to transport the printer ribbon from the ribbon supply spool support towards the ribbon take up spool support.

The second portion of the base plate may support some or all of the supply spool support, take-up spool support and first motive apparatus, ribbon supply spool support, ribbon take-up spool support and second motive apparatus.

The first motive apparatus may comprise a first motor including a first stator and a first rotor, and the second motive apparatus comprising a second motor including a second stator and a second rotor; wherein the labelling station and printhead may extend from a surface on a first side of the base plate; and wherein the following components may be mounted to the base plate such that the majority of each component is located on the first side of the base plate: supply spool support, take-up spool support, first stator, ribbon supply spool support, ribbon take-up spool support and second stator.

The labelling machine may be such that none of the supply spool support, take-up spool support, first motive apparatus, ribbon supply spool support, ribbon take-up spool support and second motive apparatus extend from the base plate in the second direction to an extent which is beyond that of the first wall.

The labelling machine may be such that no part of the labelling machine extends from the base plate in the second direction to an extent which is beyond that of the first wall.

The labelling station may extend from a surface on a first side of the first portion of the base plate; and wherein a surface on a second side of the first portion of the base plate, which is generally opposed to the first side of the first portion of the base plate, may be free from components.

The first portion may have a first thickness in a direction substantially parallel to the first direction, and the second portion may have a second thickness in said direction substantially parallel to the first direction, the second thickness being greater than the first thickness.

The first portion of the base plate may define a ledge which extends from the second portion.

The first portion may be generally triangular, first and second corners of which are located adjacent to the second portion and the third corner of which supporting the labelling station. The third corner may also support the printhead if the labelling machine includes a printer.

According to an aspect of the present invention there is provided a labelling machine comprising a supply spool support for supporting a spool of label carrying web, a labelling station arranged to remove labels from a label carrying web supported by the supply spool, a take up spool support for supporting web from which labels have been removed, and a first motive apparatus for transporting web from the supply spool support to the take up spool support via the labelling station, wherein the supply spool support, the labelling station and the take up spool support are mounted to a base plate, wherein the base plate includes a first portion which supports the labelling station such that the labelling station extends from the base plate in a first direction, and a second portion which supports at least one of the supply spool support, take-up spool support and first motive apparatus, wherein the first portion of the base plate has a thickness which is less than that of the second portion of the baseplate.

The thickness of the first portion of the base plate may be a thickness in a direction substantially parallel to the first direction, and the thickness of the second portion may be a thickness in said direction substantially parallel to the first direction.

It will be appreciated that any of the features of one aspect of the invention discussed above may be applied to another aspect of the invention discussed above.

An embodiment of the invention will now be described, by way of example, with reference to the accompanying drawings, in which.

Figure 1:
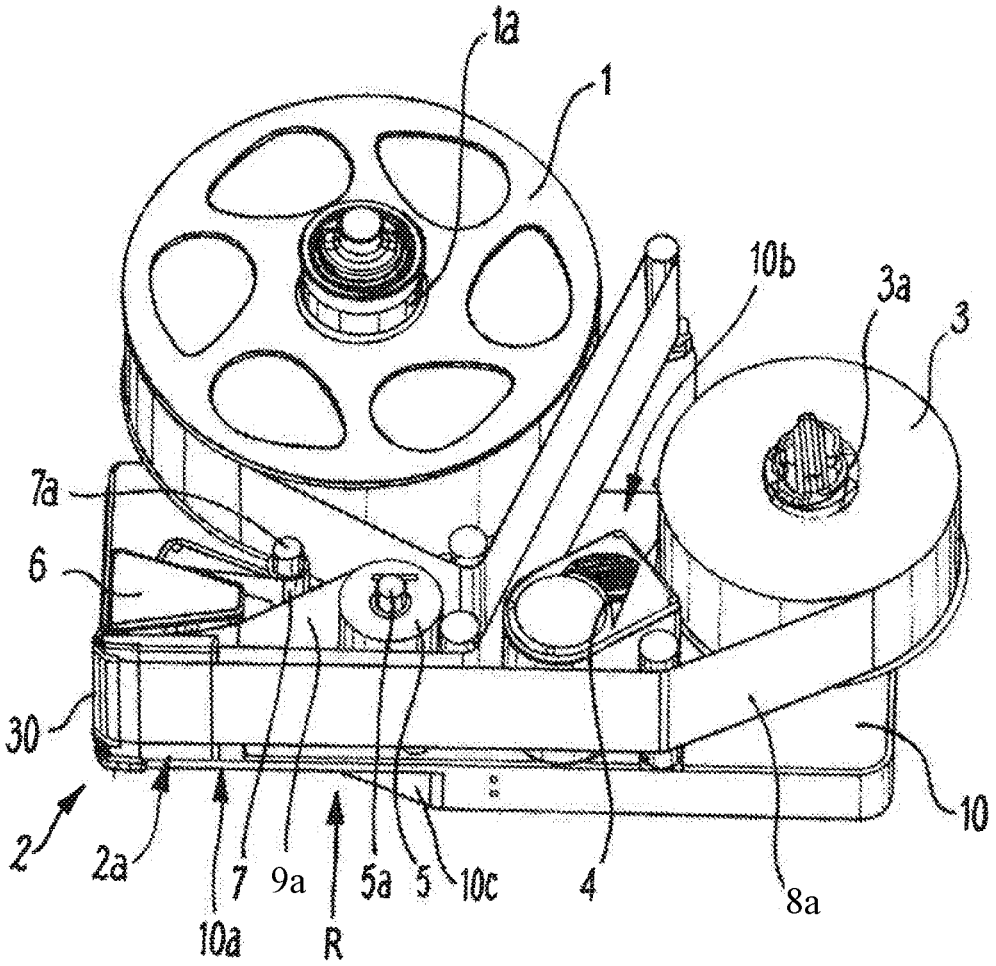
FIG. 1 is a perspective view of a print and apply labelling machine in accordance with the present invention, including a printer.

Referring to FIG. 1, there is illustrated a print and apply labelling machine in which label web material is provided as a label supply spool 1 supported by a supply spool support 1*a* and is conveyed through a labelling station 2 to a label take up spool 3 supported by a take up spool support 3*a*. The label web material comprises a plurality of labels (not shown) which are affixed to a backing paper and the labelling station is arranged to remove labels from the backing paper such that the labels are affixed to packages which are conveyed past the labelling station 2. The backing paper is then taken up onto the label take up spool 3.

A motor 4 is coupled to the label take up spool 3 via a belt drive (not shown) thereby causing rotation of the take up spool 3 and consequently movement of the label web from the label supply spool 1 to the label take up spool 3 through the labelling station 2.

The labelling station 2 includes a thermal transfer printer which is arranged to print on labels of the label web as they pass through the labelling station 2 and before they are removed from the backing paper. Further details of the thermal transfer printer are discussed below.

Ink carrying ribbon 9*a* is provided on a ribbon supply spool 5 which is supported by a ribbon supply spool support. The ribbon 9*a* passes a printhead assembly 6 and is taken up by a ribbon take-up spool 7 which is supported by a ribbon take-up spool support 7 a. The ribbon supply spool 5 is driven by a first stepper motor (not shown) while the ribbon take-up spool is driven by a second stepper motor (also not shown). In the illustrated embodiment the ribbon supply spool 5 is mounted on an output shaft of its stepper motor while the ribbon take-up spool 7 is mounted on an output shaft of its stepper motor. The stepper motors may be arranged so as to operate in push-pull mode whereby the first stepper motor rotates the ribbon supply spool 5 to pay out ribbon while the second stepper motor rotates the ribbon take-up spool 7 so as to take up tape. In such an arrangement, tension in the ribbon may be determined by control of the motors. Such an arrangement for transferring tape between spools of a thermal transfer printer is described in our earlier U.S. Pat. No. 7,150,572, the contents of which are incorporated herein by reference.

In other embodiments the ribbon 9*a* may be transported from the ribbon supply spool 5 to the ribbon take up spool 7 passed the printhead assembly 6 in other ways. For example only the ribbon take up spool may be driven by a motor while the ribbon supply spool 5 is arranged so as to provide resistance to ribbon motion, thereby causing tension in the ribbon. That is, the first motor driving the ribbon supply spool 5 may not be required in some embodiments. In some embodiments the motors driving the ribbon supply spool 5 and the ribbon take up spool 7 may be motors other than stepper motors. For example the motors driving the ribbon supply spool 5 and the ribbon take up spool 7 may be direct current (DC) motors. In general the motors driving the ribbon supply spool 5 and/or the ribbon take up spool 7 may be torque controlled motors (e.g. DC motors) or position controlled motors (e.g. stepper motors, or DC servo motors).

The printhead assembly 6 comprises a printhead (not shown) which presses the ribbon 9*a* and label web 8*a* against a print roller (not shown) to effect printing. The printhead is a thermal transfer printhead comprising a plurality of printing elements, each arranged to remove a pixel of ink from the ribbon and to deposit the removed pixel of ink on a substrate (in this case labels which form part of the label web).

The labelling station 2 includes a labelling peel beak 30. The labelling peel beak 30 is configured such that, during operation of the labelling machine, as the label web 8*a* transported along the web path past the labelling peel beak 30, the labelling peel beak 30 separates passing labels of the label web 8*a* from the backing web.

The labelling station 2 is mounted to a base plate 10.

As described above, some labelling machines may incorporate a printer and be referred to as print and apply labelling machines. A known type of print and apply labelling machine is a 'last label out' labelling machine. 'Last label out' labelling machines function so as to print a specific label for a specific article and then apply that label to the specific article. For example, a 'Last label out' labelling machine may operate such that for each article that passes the labelling machine a unique label is printed and then applied to the article. In some 'last label out' machines the printed label differs for each article, whereas in other 'last label out machines' the printed label may differ during the course of a production batch passing the labelling machine. Due to the fact that 'Last label out' labelling machines may print a unique label for each article before it is applied to the article, it is common for the printer of the labelling machine to be located in close proximity to the labelling peel beak. The location of the printer adjacent the labelling peel beak may make the portion of the labelling machine which includes the labelling peel beak bulky.

Certain known label and/or barcode positioning standards (e.g. the GS1 barcode positioning standard produced by GS1 UK) require that labels incorporating a barcode are applied by the labelling machine at a particular position on an article (which may also be referred to as a traded unit or an outer case). For example, if the labelling machine is configured to apply labels to articles which pass the labelling machine on a conveyor, then known label positioning standards may necessitate that the labelling machine is configured to apply labels to each article on the conveyor such that the bottom of a barcode symbol on each label is located at a height of approximately 32 mm from the base of the article (and hence approximately 32 mm from the conveyor). Known label positioning standards may necessitate that the labelling machine is configured to apply labels to each article on the conveyor such that a barcode symbol on each label is located at a distance of greater than approximately 19 mm from an edge of the article. The edge of the article may be a front edge of the article. The front edge of an article may be an edge of an article which is forward-most with respect to the direction of travel of the article on the conveyor.

In cases where known print and apply labelling machines of the 'last label out' type are required to apply labels to articles at a relatively low height from a conveyor (for example at a height such that the bottom of a barcode symbol on each label is located approximately 32 mm from the conveyor), due to the fact that the portion of the labelling machine which includes the labelling peel beak is bulky, it may not be possible to position such a known print and apply labelling machine of the 'last label out' type adjacent the conveyor such that labels can be printed and subsequently applied to an article at a position adjacent the labelling peel beak and printer of the labelling machine. In order to solve this problem, some known print and apply labelling machines of the 'last label out' type may be located at a position such that the labelling peel beak and printer are remote from the conveyor (and hence articles on the conveyor). Such labelling machines may then incorporate a tamp (or any other appropriate label transfer device) which is controllably moved so as to transfer each label from the labelling peel beak of the labelling machine and subsequently apply it to the required position on each article. However, the use of a tamp (or any other appropriate label transfer device) in this manner may be disadvantageous. For example, the label transfer means will increase the complexity and cost of the labelling machine. In addition, the label transfer device is an additional component of the labelling machine which may fail, thus causing the labelling machine to become inoperable. Furthermore, the time it takes for a printed label to be transferred by the label transfer device from the labelling machine to the desired article on the conveyor may increase the time it take for labels to be applied to an article, thereby reducing the throughput of the labelling machine and/or conveyor.

A labelling machine according to an embodiment of the present invention seeks to obviate or mitigate the above problem.

Figure 2:
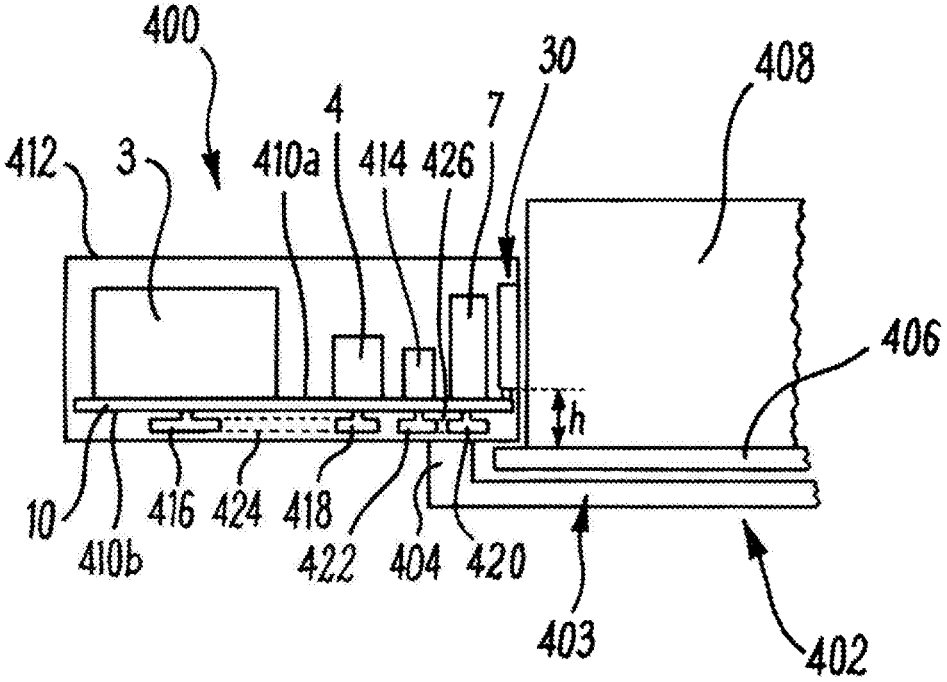
FIG. 2 is a schematic cross section through a labelling machine positioned adjacent a production line.

FIG. 2 shows a schematic cross-sectional view of a portion of a production line to which a labelling machine 400 which attempts to obviate or mitigate the above problem is mounted.

The same numbering is used in FIGS. 1 and 2 for features which are equivalent.

The portion of the production line 402 shown in the figure includes a base 403 having a sidewall 404. The base 403 supports a conveyor belt 406. The conveyor belt 406 is driven such that it travels in a direction which is into the page as shown in FIG. 2. The conveyor belt 406 is configured to support articles to be labelled by the labelling machine 400. The figure shows one such article 408 to be labelled. In this case, the article 408 is a generally cuboid box, although may be any appropriate article.

The sidewall 404 of the base extends above the surface of the conveyor belt 406 which supports the articles to be labelled by the labelling machine 400. Thus, the sidewall 404 acts as a barrier to prevent any articles being supported by the conveyor belt 406 from falling off the side of the conveyor belt 406. In other production lines the sidewall may be separate to the base. In some production lines the sidewall may extend inboard of an edge of the conveyor belt. Some production lines may not include a sidewall.

The labelling machine 400 is mounted to the production line. In this case the labelling machine is mounted to the sidewall 404 of the base 403 of the production line 402. It will be appreciated that in other embodiments the labelling machine may be mounted in any appropriate manner to the production line. In some embodiments the labelling machine may not be mounted directly to the production line. The labelling machine may be mounted in any appropriate manner providing that the labelling machine has a fixed positional relationship with a portion of the production line (for example the conveyor (e.g. conveyor belt)).

The labelling machine 400 shown in FIG. 2 may have the same configuration as (or a similar configuration to) the labelling machine discussed with reference to FIG. 1. The view of the labelling machine shown in FIG. 2 has been simplified so as to aid clarity. Various components of the labelling machine have been omitted. Furthermore, although label stock and print ribbon are shown supported by the take up spool support and ribbon take up spool support respectively (discussed in more detail below), neither the label stock or print ribbon are shown extending along their respective paths through the machine.

The labelling machine 400 comprises a take up spool support for supporting label stock as it is wound onto the take up spool 3. The labelling machine 400 also comprises a printer including a ribbon take up spool support, for supporting printer ribbon as it is wound onto the ribbon take up spool 7. The take up spool support and ribbon take up spool support are each driven for rotation by respective motors 4 and 414.

All of the components of the labelling machine mentioned in the preceding paragraph are mounted to a base plate 10 and are housed in a casing 412. Each of the take up spool support, ribbon take up spool support and motors 4 and 414 comprise a main body and a rotatable shaft which extends from the main body. The main body of each of the take up spool support, ribbon take up spool support and motors 14 and 414 is mounted to an upper surface 410*a* of the base plate 10 such that their respective rotatable shafts pass through respective apertures in the base plate 10 and extend beyond a lower surface 410*b* of the base plate 10. Pulleys 416, 420, 418, 422 are mounted to each of the respective shafts of the take up spool support, ribbon take up spool support and motors 4 and 414 such that each pulley 416, 420, 418, 422 is located on the other side of the base plate 10 compared to the respective main body.

The pulley 416 of the take up spool support is connected to the pulley 418 of the motor 4 by a first belt (shown in dashed line and indicated by 424), such that the motor 14 can drive the take up spool support (and hence take up spool 3) for rotation via the pulleys 416, 418 and the belt 424. The pulley 420 of the ribbon take up spool support is connected to the pulley 422 of the motor 414 by a second belt (shown in dashed line and indicated by 426), such that the motor 414 can drive the ribbon take up spool support (and hence ribbon take up spool 7) for rotation via the pulleys 420, 422 and the belt 426.

The supply spool support which supports the label stock and the ribbon supply spool support which supports the printer ribbon are not shown so as to improve the clarity of the figure. The supply spool support and ribbon supply spool support are also mounted to the upper surface 410*a* of the base plate 10. If either of the supply spool support and ribbon supply spool support are driven for rotation by a respective motor, then they may be driven by a motor via a belt and pulleys in a similar manner to that discussed above. Any such motor may have a main body secured to the upper surface 410*a* of the base plate 10. Again, the shaft of any motor or driven supply spool support or driven ribbon supply spool support passes through a respective aperture in the base plate.

A labelling peel beak 30 is also mounted to the base plate 10. In use, the motor 4 drives the take up spool support (and hence take up spool 3) such that a portion of the web of the label stock is wound onto the take up spool support. A print head (not shown) is controlled to transfer ink from the print ribbon onto labels of the label stock to form a desired image on each label as it passes the print head. When required the motor 414 drives the ribbon take up spool support (and hence ribbon take up spool 7) to advance the print ribbon. The advancement of the conveyor 406 is co-ordinated with the drive of the take up motor 4 such that as an article 408 passes on the conveyor 406, the take up motor 4 is driven to advance the label stock such that a label which has been printed for the article is advanced to the labelling peel beak and then separated from the web by the labelling peel beak 30 and subsequently applied to the article 408.

The arrangement of the labelling machine as discussed above, whereby the main body of each component is located on the same side of the base plate may be advantageous in certain applications. For example, due to the fact that there is little more than the pulleys and associated belts on the lower side of the of base plate (i.e. the side of the base plate which includes the lower surface), the distance between the bottom of the labelling machine and the labelling peel beak (i.e. the point at which labels are dispensed from the machine) is reduced. A reduction in the distance between the bottom of the labelling machine and the labelling peel beak means that if the labelling machine (and mere specifically has to be positioned above some feature to the side of the conveyor of the production line (for example a side wall as shown in FIG. 2), then the height h between the conveyor (e.g. the surface of the conveyor on which the conveyed articles are supported) and the labelling peel beak is minimised. By minimising the height h between the conveyor and the labelling peel beak, the minimum height on an article conveyed by the conveyor at which the labelling machine can apply a label is also reduced. This may allow the labelling machine to apply a label to an article at a height which meets a desired standard (e.g. the GS1 standard) without the need for a label transfer device.

Figure 3:
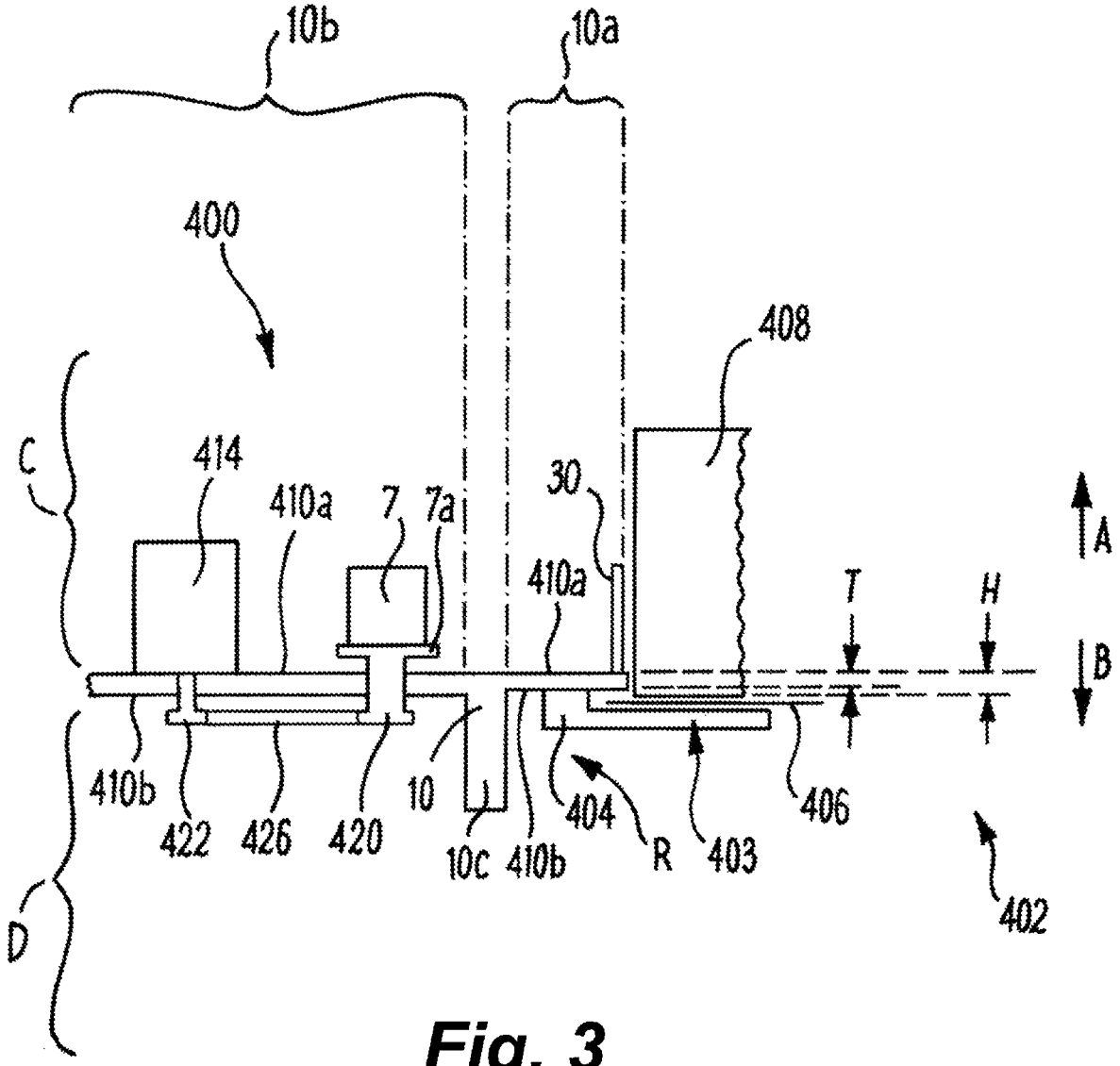
FIG. 3 is a schematic cross section through a portion of the labelling machine shown in FIG. 1, the labelling machine being positioned adjacent a production line.

FIG. 1 (previously discussed) and FIG. 3 both show a labeling machine according to an embodiment of the present invention which is a modification of the labeling machine shown in FIG. 2.

Again, features within FIGS. 1, 2 and 3 which are equivalent have been given the same numbering.

It will be appreciated that FIG. 1 shows a perspective view of the complete labeling machine in which the label web is running along the web path and printer ribbon is running between the ribbon take up spool and ribbon supply spool. However, FIG. 3 shows a schematic cross-sectional view of only a portion of the labeling machine when the labeling machine is located adjacent a production line (again, only a portion of which is shown).

The embodiment of labeling machine shown in FIGS. 1 and 3 differs from that shown in FIG. 2 in that the base plate 10 includes a first portion 10*a* and a second portion 10*b*. The first portion supports the labeling station 2 (which in this embodiment includes a labeling peel beak 30, but in other embodiments may include any apparatus arranged to remove labels from the label carrying web) and a second portion 10*b* which supports at least one of the supply spool support 1*a*, the take up spool support 3*a* and the first motive apparatus (which in this case is stepper motor 4, but in other embodiments may be any appropriate motive apparatus for transporting web from the supply spool support to the take up spool support via the labeling station). In this particular embodiment, the second portion 10*b* of the base plate 10 supports the supply spool support 1*a*, the take up spool support 3*a* and the first motive apparatus 4. In other embodiments, the second portion 10*b* of the base plate 10 may not support up to two of these components.

The first portion 10*a* of the base plate 10 supports the labeling station 2 (including peel beak 30) via a base of the labeling station such that the labeling station 2 extends from the first base plate in a first direction. The first direction is labeled by the arrow marked A within FIG. 3.

The maximum distance to which the second portion 10*b* and any component supported by the second portion 10*b* extend from the base 2*a* of the labelling station 2 in a direction antiparallel (direction marked by B in FIG. 3) to the first direction A is greater than the maximum distance to which the first portion 10*a* and any component supported by the first portion 10*a* extend from the base 2*a* of the labelling station 2 in the direction antiparallel (direction marked by B in FIG. 3) to the first direction A. In other words, the maximum distance to which the second portion 10*b* and any component supported by the second portion 10*b* extend from a plane perpendicular to the first direction and containing the base 2*a* of the labelling station 2 in a direction antiparallel (direction marked by B in FIG. 3) to the first direction A is greater than the maximum distance to which the first portion 10*a* and any component supported by the first portion 10*a* extend from a plane perpendicular to the first direction and containing the base 2*a* of the labelling station 2 in the direction antiparallel (direction marked by B in FIG. 3) to the first direction A.

Examples of components which may be supported by the baseplate have already been discussed, but, for clarity, include supply spool support, take-up spool support, first motive apparatus, ribbon supply spool support, ribbon take-up spool support, second motive apparatus. The components may be any other components of the labeling machine which are supported by the baseplate. A first wall 10*c* separates the first portion 10*a* and the second portion 10*b*. The first wall 10*c* extends in a second direction (indicated by the arrow labeled B within FIG. 3) which is generally opposed to the first direction.

In some embodiments the first wall may be defined by a cover which is secured to the baseplate.

Within the embodiment shown in FIGS. 1 and 3, the first and second directions A, B are generally antiparallel. However, in other embodiments, this need not be the case. For example, in some embodiments the first wall may extend in a direction such that a component of the direction in which it extends is opposed to the first direction. For example, the angle subtended between the first and second directions is preferably 180°, but may be any appropriate angle which is greater than 90°.

As can be seen most clearly in FIG. 3, the first wall 10*c* and the first portion 10*a* of the base plate 10 define a recess R (or space) therebetween which is configured to receive a portion of a production line. In particular, in FIG. 3, the portion of the production line which is received by the recess R includes portions of the side wall 404, the base 403 and the conveyor belt 406 of the production line 402. It will be appreciated that, in other embodiments, the labeling machine 400 may be located relative to the production line 402 such that any appropriate portion of the production line is received by the recess R.

As previously discussed, within the embodiment shown in FIGS. 1 and 3, the first motive apparatus includes a first motor 4. The motor 4 has a first stator and a first rotor (not specifically shown within the Figures). The labeling station 2 (which in this embodiment includes a labeling peel beak 30 and a printer, but in other embodiments may only include apparatus capable of removing labels from a label web when they pass the labeling station) extends from a first surface 410*a* on a first side of the base plate 10. The supply spool support 1*a*, take up spool support 3*a* and stator of the first motor are mounted to the base plate such that the majority of each component is located on the first side of the base plate 10. The first side of the base plate 10 is indicated generally within FIG. 3 as C.

It will be appreciated that in other embodiments the majority of any appropriate combination of supply spool support, take up spool support and stator of the first motive apparatus may be located on the first side of the base plate.

The first wall 10*c* extends from a surface 410*b* on a second side of the base plate 10. The second side of the base plate 10 is indicated within FIG. 3 generally by D. The second side D of the base plate 10 is generally opposed to the first side C of the base plate 10.

None of the supply spool support 1*a*, take up spool support 3*a*, or first motive apparatus 4 extend from the base plate 10 in the second direction to an extent which is beyond that of the first wall. This may be advantageous in some embodiments because this may enable a cover to be fixed to the first wall 10*c* which is capable of covering any portions of the components of the labeling machine which may be on the second side D of the base plate 10 without the cover being obstructed by portions of the supply spool support, take up spool support or first motive apparatus which extend onto the second side D of the base plate.

In the embodiment shown in FIGS. 1 and 3, the labeling machine 400 further includes a printer for printing on the labels of the label web which passes the printer. In this embodiment the labeling station 2 includes the printer. However, in other embodiments, this need not be the case. For example, the printer may be separate to the labeling station or the labeling machine may not include a printer.

The printer includes a printhead (not shown) for printing on labels of the label web. The printhead is supported by the first portion 10*a* of the base plate 10. The printer also includes a ribbon supply spool support 5*a* for supporting a ribbon supply spool 5 which includes printer ribbon for the printer. The printer also includes a ribbon take up spool support 7*a* adapted to take up a portion of the printer ribbon. Finally, the printer includes a second motive apparatus (not shown) configured to transport the printer ribbon from the ribbon supply spool support 5*a* past the printhead and towards the ribbon take up spool support 7*a*. The second motive apparatus may include one or more motors as discussed above in relation to FIG. 1.

The printer may be any appropriate type of printer. For example, the printer may be a thermal printer such as a thermal transfer printer.

Within the embodiment of labeling machine shown in FIGS. 1 and 3, the second portion 10*b* of the base plate 10*a* supports each the ribbon supply spool support 5*a*, ribbon take up spool support 7*a* and second motive apparatus (in this embodiment motors which rotate the ribbon supply spool support and ribbon take up spool support respectively). In other embodiments, the second portion 10*b* of the base plate 10 may support any combination of the ribbon supply spool support, ribbon take up spool support and second motive apparatus, provided that at least one of these components is supported by the second portion of the base plate.

The second motive apparatus includes a second motor which has a second stator and a second rotor (not shown in the Figures). The ribbon supply spool support 5*a*, ribbon take up spool support 7*a* and second stator are each mounted to the base plate such that the majority of each component is located on the first side C of the base plate 10. In the case where the second motive means includes a third motor having a third rotor and third stator, the third stator may also be mounted to the base plate 10 such that the majority of the third stator is located on the first side C of the base plate.

None of the ribbon supply spool support, ribbon take up spool support and second motor apparatus extend from the base plate 10 in the second direction B to an extent which is beyond that of the first wall 10*c*. As previously discussed, this may be advantageous in certain applications because it may make it possible for a cover to be attached to the first wall 10*c* which covers any components of the labeling machine mounted to the second portion of the base plate which have a portion which extends to the second side D of the base plate 10.

As previously discussed, the labeling station 2 (which includes peel beak 30) extends from a first surface 410*a* on a first side C of the first portion 10*a* of the base plate 10. In this embodiment the printhead of the printer also extends from a first surface 410*a* on a first side C of the first portion 10*a* of the base plate 10. The second surface 410*b* is generally opposed to the first surface 410*a*. Likewise the first side C is generally opposed to the second side D. The second surface 410*b* on the second side D of the first portion 10*a* of the base plate 10 is substantially free from components. That is to say, the second surface 410*b* of the first portion 10*a* of the base plate 10 is free from components which may extend in the second direction B from the second surface 410*b*. This enables the recess R defined by the first wall 10*c* and first portion 10*a* of the base plate 10 to accommodate a portion of production line 402.

As can be seen most clearly in FIG. 1, the first portion 10*a* of the base plate 10 has a first thickness in a direction substantially parallel to the first direction, and the second portion has a second thickness in said direction substantially parallel to the first direction. The second thickness is greater than the first thickness. In an embodiment such as this one which includes a first wall 10*c*, the difference in thickness between the first and second portions 10*a*, 10*b* of the base plate is due to the presence of the recess R.

If the second portion of the base plate has one or more component portions which extend onto the second side D of the base plate (i.e. beyond the second surface 410*b*, then the second thickness may be defined as the distance in a direction substantially parallel to the first direction between the first surface 410*a* of the second portion 10*b* of the base plate and the end of the component portion which extends the furthest away from the first surface 410*a* in said direction substantially parallel to the first direction.

The presence of first wall 10*c* may be advantageous because it may prevent or minimize the possibility that detritus or other material from a production line next to which the labeling machine 400 is located contacts portions of components of the labeling machine which are mounted to the second portion of the baseplate and which extent to the second side D of the baseplate.

In some embodiments, as shown in FIG. 1, the first wall 10*c* extends all the way around the second side D of the second portion 10*b* of the base plate 10. However, in some embodiments, this need not be the case and the first wall 10*c* may merely separate the first and second portions 10*a*, 10*b* of the base plate 10.

Embodiments of labeling machine according to the present invention (such as that shown in FIGS. 1 and 3) may be advantageous in certain situations compared to the embodiment of labeling machine shown in FIG. 2 for the reasons set out below. The thickness of the first portion 10*a* of the base plate 10 (indicated in FIG. 3 by T, the thickness being in a direction which is substantially parallel to the first direction A) is less than the thickness of the second portion 10*b* of the base plate (again, said thickness being in said direction substantially parallel to the first direction A). In this context, thickness may be taken to mean the maximum distance parallel to the first direction A that a component of the first portion or second portion of the base plate extends in the second direction B from the first surface 410*a* of the base plate from which the labeling station (for example peel beak) extends.

Because the thickness of the first portion of the base plate is less than the thickness of the second portion of the base plate, the first portion of the base plate can overhang the production line 402 such that the height H between the bottom of the labeling station and the conveyer (e.g. the surface of the conveyor on which the conveyed articles are supported) in minimized. The height H of the embodiment of the invention shown in FIGS. 1 and 3 is less than the height h of the embodiment shown in FIG. 2, because the first portion 10*a* of the base plate does not include any components which extend to the second side D of the base plate. Therefore, the first portion 10*a* of the base plate 10 and hence the labeling station mounted to the first portion of the base plate can be located and a height above the conveyor which is less than that achieved by the labeling machine shown in FIG. 2.

Reducing the height between the conveyor and the labeling station means that the minimum height of an article conveyed by the conveyor at which the labeling machine can apply a label is also reduced. This may allow the labeling machine to apply a label to an article at a height which meets a desired standard (for example the GS1 standard) without the need for a label transfer device.

It can be seen within FIGS. 1 and 3 that the labelling machine is such that the first portion 10*a* of the base plate 10 defines a ledge which extends from the second portion 10*b*.

Furthermore, the first portion 10*a* is generally triangular, first and second corners of which are located adjacent to the second portion 10*b* and the third corner of which supporting the labelling station 2 and, if present, the printhead.

Within the embodiments described above, all the components driven by motor are driven via a linkage (a pair of pulleys and a belt). This need not be the case. For example, in some embodiments at least one of the take up spool support, supply spool support, ribbon take up spool support and ribbon supply spool support may be driven directly. By directly driven it is meant that the spool support may be mounted co-axially with the shaft of the motor which drives the spool support for rotation. The spool support may be mounted to a motor spindle of a motor. In some embodiments, both the ribbon take up spool support and ribbon supply spool support may be driven directly. In the case where a spool support is driven directly by a motor, the motor may be mounted such that none of the motor protrudes past the lower surface of the base plate or such that the amount of the motor which protrudes past the lower surface of the base plate is minimised.

Although not shown in the described embodiment, in some embodiments of the present invention, the first and or second motive apparatuses may be wholly or partially located on the side of the base plate opposite to that on which the labelling station is located. More specifically, any one of the label web take up motor, label web supply motor (if present), ribbon take up motor and label supply motor (if present) may be wholly or partially located on the side of the base plate opposite to that on which the labelling station is located.

Although the base plate 410 in the described embodiments is a single component, in other embodiments the base plate may be constructed from a plurality of components.

Although the embodiments discussed above include an aperture in the base plate for each component shaft to pass through the base plate, in other embodiments more than one component shaft may pass through a single aperture. In some embodiments there may be a single aperture in the base plate through which all of the component shafts pass.

Although in the embodiments above the linkage between a spool support and motor comprises a belt and two pulleys, it will be appreciated that in other embodiments any appropriate linkage may be used. For example, chains and gears may be used instead, or alternatively meshing gear wheels may be used. In some embodiments any linkage linking a motor to a spool support may be located on the upper side of the base plate such that there is no linkage on the lower side of the base plate. That is to say, the spool support, motor and linkage linking the spool support and motor may all be located on the same side of the base plate.

Although the embodiments described above include a printer (comprising a printhead and print ribbon take-up and supply spools), in some embodiments of the present invention the printer may be omitted.

Various features of the labelling machine have been described above. In some cases, exemplary components, configurations and methods suitable for realising these particular features have been described. However in many cases the skilled person will know of other components, configurations and methods which can similarly be used to realise the particular features which are described. Many of these components, configurations and methods will be known to the skilled person from the common general knowledge. It is envisaged that such alternative components, configurations and methods can be implemented in the described embodiments without difficulty given the disclosure presented herein.

While references have been made herein to a controller or controllers it will be appreciated that control functionality described herein can be provided by one or more controllers. Such controllers can take any suitable form. For example control may be provided by one or more appropriately programmed microprocessors (having associated storage for program code, such storage including volatile and/or non-volatile storage). Alternatively or additionally control may be provided by other control hardware such as, but not limited to, application specific integrated circuits (ASICs) and/or one or more appropriately configured field programmable gate arrays (FPGAs).

Where angles have been specified herein, such angles are measured in radians although modifications to use other angular measurements will be apparent to the skilled person.

While various embodiments of labelling machine(s) have been described herein, it will be appreciated that this description is in all respects illustrative, not restrictive. Various modifications will be apparent to the skilled person without departing from the spirit and scope of the invention.

The invention claimed is:

1. A labelling machine comprising:

a base plate comprising a corner that defines a right angle;

a labeling station mounted at the corner of the base plate and extending in a first direction from the base plate;

a wall extending from a lower surface of the base plate in a second direction opposite to the first direction so that a first portion of the base plate is on a first side of the wall and a second portion of the base plate is on a second side of the wall, wherein the wall is oriented at an angle relative to each of a pair of sides of the base plate defining the corner; and a supply spool support for supporting a spool of label carrying web, a take up spool support for supporting web from which labels have been removed and a first motive apparatus for transporting web from the supply spool support to the take up spool support via the labeling station, wherein the supply spool support, the take up spool support and the first motive apparatus are mounted in the second portion of the base plate and extend in the first direction from the base plate;

wherein the labeling station is mounted in the first portion of the base plate;

wherein the wall and the lower surface of the first portion of the base plate define a recess configured to receive a production line.

2. The labeling machine of claim 1, wherein the base plate is a rectangular base plate.

3. The labeling machine of claim 1, wherein the labeling station is mounted to the corner along an upper surface of the first portion of the base plate and wherein the recess is defined by the lower surface of the first portion of the base plate opposite to the corner.

4. The labeling machine of claim 1, wherein the angle is greater than 0 degrees and less than 90 degrees so that the first wall defines a triangular shaped recess between the wall and lower surface of the base plate.

5. The labelling machine of claim 1, wherein the first portion of the base plate has a thickness which is less than a thickness of the second portion of the baseplate.

6. The labelling machine of claim 1, wherein the labelling machine further includes a printer for printing on labels of the label web.

7. The labelling machine of claim 6, wherein the printer includes a printhead, the printhead being supported by the first portion of the base plate.

8. The labelling machine according to claim 1, wherein the supply spool support, the take up spool support and the first motive apparatus supported by the second portion are housed in a casing which extends from the base plate in the first direction.

9. The labelling machine according to claim 1, wherein the first motive apparatus comprises a rotatable shaft that extends through an aperture in the base plate and beyond the lower surface of the base plate.

10. A labelling machine comprising:

a base plate comprising a corner that defines a right angle;

a labeling station mounted at the corner of the base plate and extending in a first direction from the base plate;

a wall extending from a lower surface of the base plate in a second direction opposite to the first direction so that a first portion of the base plate is on a first side of the wall and a second portion of the base plate is on a second side of the wall, wherein the wall is oriented at an angle relative to each of a pair of sides of the base plate defining the corner; and a component configured to supply a plurality of labels affixed to backing paper to the labeling station, said component mounted in the second portion of the shaped base plate and extending in the first direction from the base plate;

wherein the labeling station is mounted in the first portion of the base plate;

wherein the wall and the lower surface of the first portion of the base plate define a recess configured to receive a production line.

11. The labeling machine of claim 10, wherein the base plate is a rectangular base plate.

12. The labeling machine of claim 10, wherein the labeling station is mounted to the corner along an upper surface of the first portion of the base plate and wherein the recess is defined by the lower surface of the first portion of the base plate opposite to the corner.

13. The labeling machine of claim 10, wherein the angle is greater than 0 degrees and less than 90 degrees so that the first wall defines a triangular shaped recess between the wall and a lower surface of the base plate.

14. The labelling machine of claim 10, wherein the first portion of the base plate has a thickness which is less than a thickness of the second portion of the baseplate; and wherein the component comprises a rotatable shaft that extends through an aperture in the base plate and beyond the lower surface of the base plate.

15. The labelling machine of claim 10, wherein the labelling machine further includes a printer for printing on the labels;

and wherein the printer includes a printhead, the printhead being supported by the first portion of the base plate.

16. The labelling machine according to claim 10, wherein the component comprises a supply spool support for supporting a spool of label carrying web, a take up spool support for supporting web from which labels have been removed and a first motive apparatus for transporting web from the supply spool support to the take up spool support via the labeling station;

and wherein the supply spool support, the take up spool support and the first motive apparatus [mounted in] the second portion are housed in a casing which extends from the base plate in the first direction.

* * * * *